252-104 AU 157 EX
3/3/87 XR 4,647,393

United States Patent [19]

Ouhadi et al.

[11] Patent Number: 4,647,393

[45] Date of Patent: Mar. 3, 1987

[54] LOW PHOSPHATE OR PHOSPHATE FREE NONAQUEOUS LIQUID NONIONIC LAUNDRY DETERGENT COMPOSITION AND METHOD OF USE

[75] Inventors: Trazollah Ouhadi, Liege; Louis Dehan, Seraing; Lucie Fellen, Grivegnee, all of Belgium

[73] Assignee: Colgate-Palmolive Company, New York, N.Y.

[21] Appl. No.: 762,163

[22] Filed: Aug. 5, 1985

[51] Int. Cl.[4] ..... C11D 1/72; C11D 3/395; C11D 3/43

[52] U.S. Cl. ..... 252/102; 252/95; 252/104; 252/174.12; 252/174.16; 252/174.19; 252/174.21; 252/174.22; 252/171; 252/DIG. 1; 252/DIG. 14

[58] Field of Search ..... 252/174.21, 174.22, 252/89.1, 174.16, 174.19, 170, 174.12, 171, 95, 99, 102, 104, 135, DIG. 11, DIG. 14, DIG. 1

[56] References Cited

U.S. PATENT DOCUMENTS

| | | | |
|---|---|---|---|
| 3,539,464 | 11/1970 | Harper et al. | 252/181 |
| 3,705,856 | 12/1972 | Sedliar et al. | 252/156 |
| 3,805,831 | 11/1974 | Hellsten | 252/99 |
| 3,956,157 | 5/1976 | Marans | 252/95 |
| 4,075,116 | 2/1978 | Mesaros | 252/102 |
| 4,230,592 | 10/1980 | Miller et al. | 252/156 |
| 4,326,979 | 4/1982 | Bus et al. | 252/158 |
| 4,388,205 | 6/1983 | Stettler et al. | 252/135 |
| 4,390,465 | 6/1983 | Spekman | 252/527 |

*Primary Examiner*—Prince E. Willis
*Attorney, Agent, or Firm*—Herbert S. Sylvester; Murray M. Grill; Norman Blumenkopf

[57] ABSTRACT

A low polyphosphate or a polyphosphate free liquid heavy duty laundry detergent composition comprising a suspension of an alkali metal heptonic acid builder salt in liquid nonionic surfactant. The laundry detergent composition comprises a nonaqueous liquid nonionic surfactant containing a stable suspension of an alkali metal heptonic acid builder salt.

20 Claims, 2 Drawing Figures

LOW PHOSPHATE OR PHOSPHATE FREE NONAQUEOUS LIQUID NONIONIC LAUNDRY DETERGENT COMPOSITION AND METHOD OF USE

BACKGROUND OF THE INVENTION (1) Field of Invention

This invention relates to nonaqueous liquid fabric treating compositions. More particularly, this invention relates to phosphate free or low phosphate nonaqueous liquid laundry detergent compositions containing a suspension of a heptonate builder salt in nonionic surfactants which compositions are stable against phase separation and gelation and are easily pourable and to the use of these compositions for cleaning soiled fabrics.

(2) Discussion of Prior Art

Liquid nonaqueous heavy duty laundry detergent compositions are well known in the art. For instance, compositions of that type may comprise a liquid nonionic surfactant in which are dispersed particles of a builder, as shown for instance in the U.S. Pat. Nos. 4,316,812, 3,630,929 and 4,264,466 and British Pat. Nos. 1,205,711, 1,270,040 and 1,600,981.

The related pending applications assigned to the common assignee are

Ser. No. 687,815, filed Dec. 31, 1984;

Ser. No. 597,793, filed Apr. 6, 1984; now abandoned

Ser. No. 597,948, filed Apr. 9, 1984; now abandoned

Ser. No. 725,455, filed Apr. 22, 1985; and

Ser. No. (IR 220/221), filed

These applications are directed to liquid nonaqueous nonionic laundry detergent compositions.

The washing power of synthetic nonionic surfactant detergents in laundry detergent compositions can be increased by the addition of builders. Sodium tripolyphosphate is one of the preferred builders. However, the use of sodium polyphosphate in dry powder detergents does involve several disadvantages such as, for example, the tendency of the polyphosphates to hydrolyse into pyro- and ortho-phosphates which represent less valuable builders.

In addition the polyphosphate content of laundry detergents has been blamed for the undesirably high phosphate content of surface water. An increased phosphate content in surface water has been found to contribute towards greater algea growth with the result that the biological equilibrium of the water can be adversely altered.

Recently enacted government legislation has been directed to reducing the amount of polyphosphates present in laundry detergents and in some jurisdictions in which polyphosphates have been a problem to require that the laundry detergents not contain any polyphosphate builders.

Liquid detergents are often considered to be more convenient to employ than dry powdered or particulate products and, therefore, have found substantial favor with consumers. They are readily measurable, speedily dissolved in the wash water, capable of being easily applied in concentrated solutions or dispersions to soiled areas on garments to be laundered and are nondusting, and they usually occupy less storage space. Additionally, the liquid detergents may have incorporated in their formulations materials which cound not stand drying operations without deterioration, which materials are often desirably employed in the manufacture of particulate detergent products. Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

In addition to the problem of settling or phase separation the nonaqueous liquid laundry detergents based on liquid nonionic surfactants suffer from the drawback that the nonionics tend to gel when added to cold water. This is a particularly important problem in the ordinary use of European household automatic washing machines where the user places the laundry detergent composition in a dispensing unit (e.g. a dispensing drawer) of the machine. During the operation of the machine the detergent in the dispenser is subjected to a stream of cold water to transfer it to the main body of wash solution. Especially during the winter months when the detergent composition and water fed to the dispenser are particularly cold, the detergent viscosity increases markedly and a gel forms. As a result some of the composition is not flushed completely off the dispenser during operation of the machine, and a deposit of the composition builds up with repeated wash cycles, eventually requiring the user to flush the dispenser with hot water.

The gelling phonomenon can also be a problem whenever it is desired to carry out washing using cold water as may be recommended for certain synthetic and delicate fabrics or fabrics which can shrink in warm or hot water.

The tendency of concentrated detergent compositions to gel during storage is aggrevated by storing the compositions in unheated storage areas, or by shipping the compositions during winter months in unheated transportation vehicles.

Partial solutions to the gelling problem have been proposed, for example, by diluting the liquid nonionic with certain viscosity controlling solvents and gel-inhibiting agents, such as lower alkanols, e.g. ethyl alcohol (see U.S. Pat. No. 3,953,380), alkali metal formates and adipates (see U.S. Pat. No. 4,368,147), hexylene glycol, polyethylene glycol, etc. and nonionic structure modification and optimization. As an example of nonionic surfactant modification one particularly successful result has been achieved by acidifying the hydroxyl moiety end group of the nonionic molecule. The advantages of introducing a carboxylic acid at the end of the nonionic include gel inhibition upon dilution; decreasing the nonionic pour point; and formation of an anionic surfactant when neutralized in the washing liquor. Nonionic structure optimization has centered on the chain length of the hydrophobic-lipophilic moiety and the number and make-up of alkylene oxide (e.g. ethylene oxide) units of the hydrophilic moiety. For example, it has been found that a $C_{13}$ fatty alcohol ethoxylated with 8 moles of ethylene oxide presents only a limited tendency to gel formation.

Nevertheless, improvements are desired in both the stability and gel inhibition of low phosphate and phosphate free nonaqueous liquid fabric treating compositions.

BRIEF DESCRIPTION OF THE INVENTION

In accordance with the present invention a highly concentrated low phosphate, more particularly a polyphosphate detergent builder free, nonaqueous liquid laundry detergent composition is prepared by dispersing heptonate builder salts in a liquid nonionic surfactant detergent.

The heptonic acid salts used inaccordance with the present invention are well known. The heptonic acid is an acid derivative of an aldoheptose (monosacchride). The alkali metal salts of heptonic acid are water soluble.

The alkali metal heptonic acid salts used in the present invention have the general formula

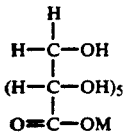

wherein M is an alkali metal or ammonium cation.

In order to improve the viscosity characteristics of the composition an acid terminated nonionic surfactant can be added. To further improve the viscosity characteristics of the composition and the storage properties of the composition there can be added to the composition viscosity improving and anti gel agent such alkylene glycol mono alkyl ethers and anti settling agents such as phosphoric acid esters and aluminum stearate. In preferred embodiment of the invention the detergent composition contains an acid terminated nonionic surfactant and/or an alkylene glycol mono alkyl ether, and an anti settling agent.

Sanitizing or bleaching agents and activators therefore can be added to improve the bleaching and cleansing characteristics of the composition.

In an embodiment of the invention the builder components of the composition are ground to a particle size of less than 100 microns and to preferably less than 10 microns to further improve the stability of the suspension of the builder components in the liquid nonionic surfactant detergent.

In addition other ingredients can be added to the composition such as anti-incrustation agents, anti-foam agents, optical brighteners, enzymes anti-redeposition agents, perfume and dyes.

The presently manufactured washing machines for home use normally operate at washing temperatures of up to 100° C. Up to 18.5 gallons (70 liters) of water are used during the wash and rinse cycles.

About 175 gms of powder detergent per wash is normally used.

In accordance with the present invention where the highly concentrated liquid detergent is used normally only about 100 gms (77 ml) or less of the liquid detergent composition is required to wash a full load of dirty laundry.

Accordingly, in one aspect the present invention there is provided a phosphate builder free or substantially phosphate builder free liquid heavy duty laundry composition composed of a suspension of an alkali metal heptonic acid builder salt in liquid nonionic surfactant.

According to another aspect, the invention provides a phosphate free or low phosphate concentrated liquid heavy duty laundry detergent composition which is stable, non-settling in storage and non-gelling in storage and in use. The liquid compositions of the present invention are easily pourable, easily measured and easily put into the washing machine.

According to another aspect, the invention provides a method for dispensing a phosphate free or low phosphate liquid nonionic laundry detergent composition into and/or with cold water without undergoing gelation. In particular, a method is provided for filling a container with a nonaqueous liquid laundry detergent composition in which the detergent is composed, at least predominantly, of a polyphosphate builder free liquid nonionic surface active agent and for dispensing the composition from the container into an aqueous wash bath, wherein the dispensing is effected by directing a stream of unheated water onto the composition such that the composition is carried by the stream of water into the wash bath.

ADVANTAGES OVER THE PRIOR ART

The polyphosphate builder free detergent compositions overcome the problem of phosphate pollution of surface water.

The polyphosphate free or low polyphosphate concentrated nonaqueous liquid nonionic surfactant laundry detergent compositions of the present invention have the added advantages of being stable, non-settling in storage, and non-gelling in storage. The liquid compositions are easily pourable, easily measured and easily put into the laundry washing machines.

BRIEF DESCRIPTION OF THE DRAWINGS

The FIG. 1 of the drawings is a graphic illustration comparing the encrustation buildup in washing machines at concentrations of 1 to 9 gm/liter of laundry detergent compositions containing sodium heptonate and sodium polyphosphate.

The FIG. 2 of the drawings is a graphic illustration comparing the encrustation buildup in washing machines after three to twelve washing cycles using laundry detergent compositions containing sodium heptonate and sodium polyphosphate.

OBJECTS OF THE INVENTION

Figure 1:
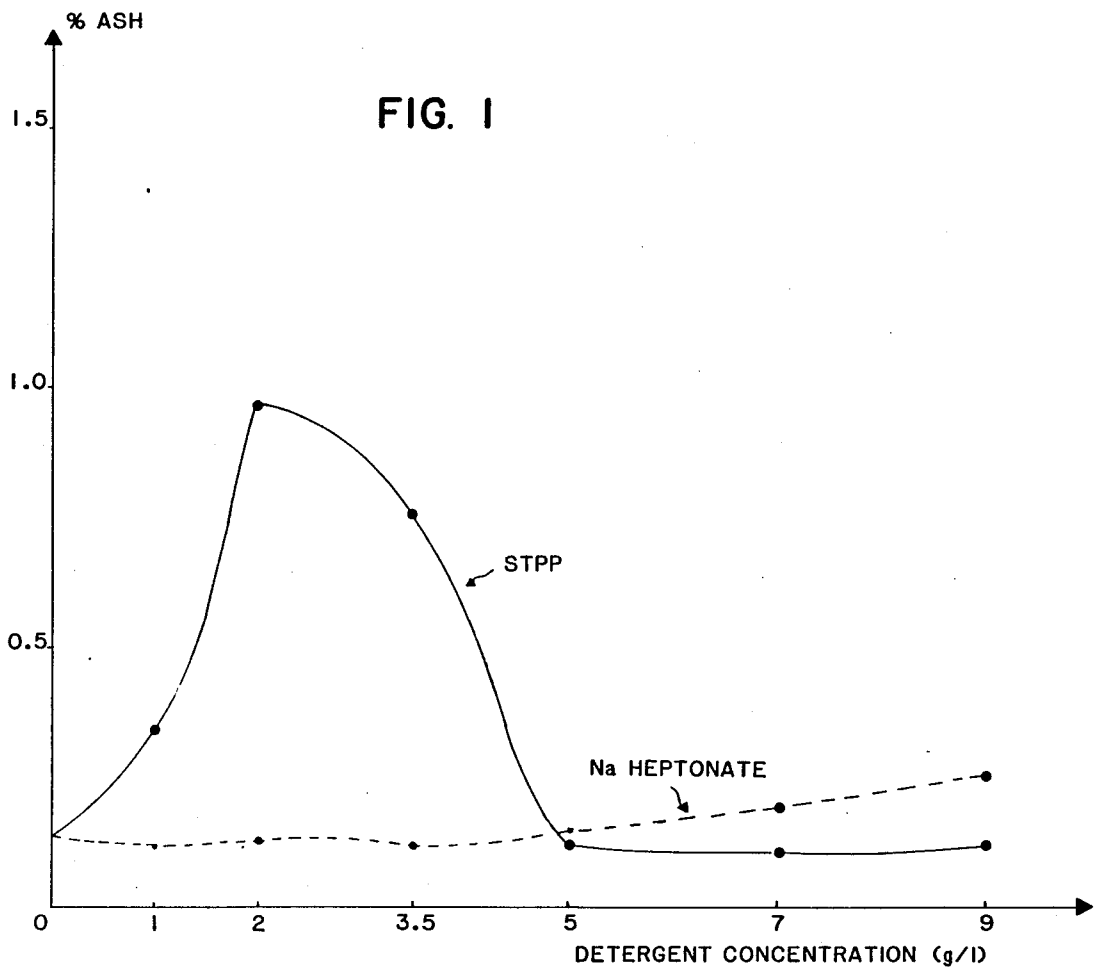

It is an object of the present invention to provide a low polyphosphate, more particularly a polyphosphate free non-polluting liquid heavy duty nonaqueous nonionic detergent composition containing heptonate builder salt suspended in a nonionic surfactant.

It is another object of the invention to provide a polyphosphate free or low polyphosphate liquid fabric treating compositions which are suspensions of heptonate builder salt in a nonaqueous liquid and which are storage stable, easily pourable and dispersible in cold, warm or hot water.

Another object of this invention is to formulate a polyphosphate free or low polyphosphate highly built heavy duty nonaqueous liquid nonionic surfactant laundry detergent compositions which can be poured at all temperatures and which can be repeatedly dispersed from the dispensing unit of European style automatic laundry washing machines without fouling or plugging of the dispenser even during the winter months.

Another object of this invention is to provide a polyphosphate free or low polyphosphate non-gelling, stable suspensions of heavy duty built nonaqueous liquid nonionic laundry detergent composition which include an effective amount of heptonate builder salt.

A further object of this invention is to provide non-gelling, stable suspensions of heavy duty built nonaqueous liquid nonionic laundry detergent composition which include an amount of phosphoric acid alkanol ester and/or aluminum fatty acid salt anti-settling agent which is sufficient to increase the stability of the composition, i.e. prevent settling of builder particles, etc., preferably while reducing or at least without increasing the plastic viscosity of the composition.

These and other objects of the invention which will become more apparent from the following detailed description of preferred embodiments are generally provided for by preparing a low polyphosphate or polyphosphate free detergent builder composition by adding to the nonaqueous liquid nonionic surfactant an effective amount of an alkali metal heptonate builder salt and inorganic or organic fabric treating additives, e.g. viscosity improving and anti-gel agents, anti-settling agents, anti-incrustation agents, bleaching agents, bleach activators, anti-foam agents, optical brighteners, enzymes, anti-redeposition agents, perfume and dyes.

NONIONIC SURFACTANT DETERGENT

The nonionic synthetic organic detergents employed in the practice of the invention may be any of a wide variety of such compounds, which are well known.

As is well known, the nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxy ethylene chain can be readily adjusted to achieve the desired balance between the hydrophobic and hydrophilic groups. Typical suitable nonionic surfactants are those disclosed in U.S. Pat. Nos. 4,316,812 and 3,630,929.

Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 9 to 18 carbon atoms and wherein the number of mols of lower alkylene oxide (of 2 or 3 carbon atoms) is from 3 to 12. Of such materials it is preferred to employ those wherein the higher alkanol is a higher fatty alcohol of 9 to 11 or 12 to 15 carbon atoms and which contain from 5 to 8 or 5 to 9 lower alkoxy groups per mol. Preferably, the lower alkoxy is ethoxy but in some instances, it may be desirably mixed with propoxy, the latter, if present, often being a minor (less than 50%) proportion.

Exemplary of such compounds are those wherein the alkanol is of 12 to 15 carbon atoms and which contain about 7 ethylene oxide groups per mol, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols.

Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present composition as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company.

Other useful nonionics are represented by the commercially well known class of nonionics sold under the trademark Plurafac. The Plurafacs are the reaction product of a higher linear alcohol and a mixture of ethylene and propylene oxides, containing a mixed chain of ethylene oxide and propylene oxide, terminated by a hydroxyl group. Examples include Plurafac RA30 (a $C_{13}$–$C_{15}$ fatty alcohol condensed with 6 moles ethylene oxide and 3 moles propylene oxide), Plurafac RA40 (a $C_{13}$–$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide.

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the ethoxy chain, if such branched alkyl is not more than three carbons in length. Normally, the proportion of carbon atoms in such a branched configuration will be minor rarely exceeding 20% of the total carbon atom content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 20% but, as is in the cases of the mentioned Terigtols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of the viscosity and gel controlling compounds of the invention can also improve the properties of the detergents based on such nonionics. In some cases, as when a higher molecular weight poly lower alkoxylated higher alkanol is employed, often for its detergency, the proportion thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures.

Another useful group of nonionic surfactants are the "Surfactant T" series of nonionics available from British Petroleum. The Surfactant T nonionics are obtained by the ethoxylation of secondary $C_{13}$ fatty alcohols having a narrow ethylene oxide distribution. The Surfactant T5 has an average of 5 moles of ethylene oxide; Surfactant T7 an average of 7 moles of ethylene oxide; Surfactant T9 an average of 9 moles of ethylene oxide and Surfactant T12 an average of 12 moles of ethylene oxide per mole of secondary $C_{13}$ fatty alcohol.

In the compositions of this invention, preferred nonionic surfactants include the $C_{13}$–$C_{15}$ secondary fatty alcohols with relatively narrow contents of ethylene oxide in the range of from about 7 to 9 moles, and the C9 to C11 fatty alcohols ethoxylated with about 5–6 moles ethylene oxide.

Mixtures of two or more of the liquid nonionic surfactants can be used and in some cases advantages can be obtained by the use of such mixtures.

ACID TERMINATED NONIONIC SURFACTANT

The viscosity and gel properties of the liquid detergent compositions can be improved by including in the composition an effective amount an acid terminated liquid nonionic surfactant. The acid terminated nonionic surfactants consist of a nonionic surfactant which has been modified to convert a free hydroxyl group thereof to a moiety having a free carboxyl group, such as an ester or a partial ester of a nonionic surfactant and a polycarboxylic acid or anhydride.

As disclosed in the commonly assigned copending application Ser. No. 597,948 filed Apr. 9, 1984, now abandoned, the disclosure of which is incorporated herein by reference, the free carboxyl group modified nonionic surfactants, which may be broadly characterized as polyether carboxylic acids, function to lower the temperature at which the liquid nonionic forms a gel with water.

The addition of the acid terminated nonionic surfactants to the liquid nonionic surfactant aids in the dispensibility of the composition, i.e. pourability, and lowers the temperature at which the liquid nonionic surfactants form a gel in water without a decrease in their stability against settling. The acid terminated nonionic surfactant reacts in the washing machine water with the alkalinity of the dispersed builder salt phase of the detergent composition and acts as an effective anionic surfactant.

Specific examples include the half-esters of Plurafac RA30 with succinic anhydride, the ester or half ester of Dobanol 25-7 with succinic anhydride, and the ester or half ester of Dobanol 91-5 with succinic anhydride. Instead of succinic anhydride, other polycarboxylic acids or anhydrides can be used, e.g. maleic acid, maleic acid anhydrided, citric acid and the like.

The acid terminated nonionic surfactants can be prepared as follows:

Acid Terminated Plurafac 30. 400 g of Plurafac 30 nonionic surfactant which is a $C_{13}$ to $C_{15}$ alkanol which has been alkoxylated to introduce 6 ethyleneoxide and 3 propylene oxide units per alkanol unit is mixed with 32 g of succinic anhydride and heated for 7 hours at 100° C. The mixture is cooled and filtered to remove unreacted succinic material. Infrared analysis indicated that about one half of the nonionic surfactant has been converted to the acidic half-ester thereof.

Acid Terminated Dobanol 25-7. 522 g of Dobanol 25-7 nonionic surfactant which is the product of ethoxylation of a $C_{12}$ to $C_{15}$ alkanol and has about 7 ethyleneoxide units per molecule of alkanol is mixed with 100 g of succinic anhydride and 0.1 g of pyridine (which acts as an esterification catalyst) and heated at 260° C. for 2 hours, cooled and filtered to remove unreacted succinic material. Infrared analysis indicates that substantially all the free hydroxyls of the surfactant have reacted.

Acid Terminate Dobanol 91-5. 1000 of Dobanol 91-5 nonionic surfactant which is the product of ethoxylation of a $C_9$ to $C_{11}$ alkanol and has about 5 ethylene oxide units per molecule of alkanol is mixed with 265 g of succinic anhydride and 0.1 g of pyridine catalyst and heated at 260° C. for 2 hours, cooled and filtered to remove unreacted succinic material. Infrared analysis indicates that substantially all the free hydroxyls of the surfactant have reacted.

Other esterification catalysts, such as an alkali metal alkoxide (e.g. sodium methoxide) may be used in place of, or in admixture with, the pyridine.

The acid polyether compound, i.e. the acid terminated nonionic surfactant is preferably added dissolved in the nonionic surfactant.

BUILDER SALTS

The liquid nonaqueous nonionic surfactant used in the compositions of the present invention has dispersed and suspended therein fine particles of organic and/or inorganic detergent builder salts.

The present invention includes as an essential part of the composition an organic heptonate builder salt.

ORGANIC BUILDER SALTS

The preferred organic builder salts comprises alkali metal salts of heptonic acid, preferably the sodium and potassium salts.

Other monosaccharide acid salts that can be used are any monosaccharide acid salts with a longer chain.

A specific example of monosaccharide acid salts is heptonic acid sodium salt.

Other organic builders that can be used are polymers and copolymers of polyacrylic acid and polymaleic anhydride and the alkali metal salts thereof. More specifically such builder salts can consist of a copolymer which is the reaction product of about equal moles of methacrylic acid and maleic anhydride which has been completely neutralized to form the sodium salt thereof. The builder is commercially available under the tradename of Sokalan CP5. This builder serves when used even in small amounts to inhibit encrustation, i.e. as an anti-encrustation agent.

Since the compositions of this invention are generally highly concentrated, and, therefore, may be used at relatively low dosages, it is desirable to supplement the builder with an auxiliary builder such as an alkali metal lower polycarboxylic acid having high calcium and magnesium binding capacity to inhibit incrustation which could otherwise be caused by formation of insoluble calcium and magnesium salts. Suitable alkali metal polycarboxylic acids are alkali metal salts of citric and tartaric acid, e.g. nonosodium citrate (anhydrous), trisodium citrate, glutaric acid salt, gluconic acid salt and diacid salt with longer chain.

Examples of organic alkaline sequestrant builder salts which can be used with the heptonate builder salts or in admixture with other organic and inorganic builders are alkali metal, ammonium or substituted ammonium, aminopolycarboxylates, e.g. sodium and potassium ethylene diaminetetraacetate (EDTA), sodium and potassium nitriloacetates (NTA) and triethanolammonium N-(2-hydroxyethyl)nitrilodiacetates. Mixed salts of these aminopolycarboxylates are also suitable.

Other suitable builders of the organic type include carboxymethylsuccinates, tartronates and glycollates.

INORGANIC BUILDER SALTS

The invention detergent compositions can also include inorganic water soluble and/or water insoluble detergent builder salts. Suitable inorganic alkaline builder salts that can be used are alkali metal carbonate, borates, bicarbonates, and silicates. (Ammonium or substituted ammonium salts can also be used.) Specific examples of such salts are sodium carbonate, sodium tetraborate, sodium bicarbonate, sodium sesquicarbonate and potassium bicarbonate.

The alkali metal silicates are useful builder salts which also function to adjust or control the pH and to make the composition anticorrosive to washing machine parts. Sodium silicates of $Na_2O/SiO_2$ ratios of from 1.6/1 to 1/3.2, especially about 1/2 to 1/2.8 are preferred. Potassium silicates of the same ratios can also be used.

Though it is preferred that the detergent composition be phosphate or polyphosphate free or substantially polyphosphate free, small amounts of the conventional polyphosphate builder salts can be added where the local legislation permits such use. Specific examples of such builder salts are sodium tripolyphosphate (TPP), sodium pyrophosphate, potassium pyrophosphate, potassium tripolyphosphate and sodium hexametaphosphate. The sodium tripolyphosphate (TPP) is a preferred polyphosphate. In the formulations where the polyphosphate is added it is added in an amount of 0 to 50%, such as 0 to 30% and 5 to 15. As mentioned previously, however, it is preferred that the formulations be polyphosphate free or substantially polyphosphate free.

Other typical suitable builders include, for example, those disclosed in U.S. Pat. Nos. 4,316,812, 4,264,466 and 3,630,929. The inorganic alkaline builder salts can be used with the nonionic surfactant detergent compound or in admixture with other organic or inorganic builder salts.

The water insoluble crystalline and amorphous aluminosilicate zeolites can be used. The zeolites generally have the formula $$(M_2O)_x \cdot (Al_2O_3)_y \cdot (SiO_2)_z \cdot wH_2O$$

wherein x is 1, y is from 0.8 to 1.2 and preferably 1, z is from 1.5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq lg.

Various crystalline zeolites (i.e. alumino-silicates) that can be used are described in British Pat. No. 1,504,168, U.S. Pat. No. 4,409,136 and Canadian Pat. Nos. 1,072,835 and 1,087,477, all of which are hereby incorporated by reference for such descriptions. An example of amorphous zeolites useful herein can be found in Belgium Pat. No. 835,351 and this patent too is incorporated herein by reference.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc., may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Dugan.

VISCOSITY CONTROL AND ANTI GEL AGENTS

The inclusion in the detergent composition of an effective amount of low molecular weight amphiphilic compounds which function as viscosity control and gel-inhibiting agents for the nonionic surfactant substantially improves the storage properties of the composition. The amphiphilic compounds can be considered to be analagous in chemical structure to the ethoxylated and/or propoxylated fatty alcohol liquid nonionic surfactants but have relatively short hydrocarbon chain lengths ($C_2$ to $C_8$) and a low content of ethylene oxide (about 2 to 6 ethylene oxide groups per molecule).

Suitable amphiphilic compounds can be represented by the following general formula $$RO(CH_2CH_2O)_nH$$

where R is a $C_2$–$C_8$ alkyl group, and n is a number of from about 1 to 6, on average.

Specifically the compounds are lower ($C_2$ to $C_3$) alkylene glycol mono lower ($C_2$ to $C_5$) alkyl ethers.

More specifically the compounds are mono di- or tri lower ($C_2$ to $C_3$) alkylene glycol mono lower ($C_1$ to $C_5$) alkyl ethers.

Specific examples of suitable amphiphilic compounds include ethylene glycol monoethyle ether $C_2H_5—O—CH_2CH_2OH$, diethylene glycol monobutyl ether $C_4H_9—O—(CH_2CH_2O)_2H$, tetraethylene glycol monobutyl ether $C_4H_7—O—(CH_2CH_2O)_4H$ and dipropylene glycol monomethyl ether $CH_3—O—(CH_2\underset{\underset{CH_3}{|}}{C}HO)_2H$.

Diethylene glycol monobutyl ether is especially preferred.

The inclusion in the composition of the low molecular weight lower alkylene glycol mono alkyl ether decreases the viscosity of the composition, such that it is more easily pourable, improves the stability against settling and improves the dispersibility of the composition on the addition to warm water or cold water.

The compositions of the present invention have improved viscosity and stability characteristics and remain stable and pourable at temperatures as low as abut 5° C. and lower.

STABILIZING AGENTS

In an embodiment of this invention the physical stability of the suspension of the detergent builder compound or compounds and any other suspended additive, such as bleaching agent, etc., in the liquid vehicle is improved by the presence of a stabilizing agent which is an alkanol ester of phosporic acid or an aluminum salt of a higher fatty acid.

Improvements in stability of the composition may be achieved in certain formulations by incorporation of a small effective amount of an acidic organic phosphorus compound having an acidic-POH group, such as a partial ester of phosphorous acid and an alkanol.

As disclosed in the commonly assigned copending application Ser. No. 597,948 filed Apr. 9, 1984, now abandoned the disclosure of which is incorporated herein by reference, the acidic organic phosphorus compound having an acidic-POH group can increase the stability of the suspension of builders in the nonaqueous liquid nonionic surfactant.

The acidic organic phosphorus compound may be, for instanc, a partial ester of phosphoric acid and an alcohol such as an alkanol which has a lipophilic character, having, for instance, more than 5 carbon atoms, e.g. 8 to 20 carbon atoms.

A specific example is a partial ester of phosphoric acid and a $C_{16}$ to $C_{18}$ alkanol (Empiphos 5632 from Marchon); it is made up of about 35% monoester and 65% diester.

The inclusion of quite small amounts of the acidic organic phosphorus compound makes the suspension significantly more stable against settling on standing but remains pourable, while, for the low concentration of stabilizer, e.g. below about 1%, its plastic viscosity will generally decrease.

Further improvements in the stability and anti-settling properties of the composition may be achieved by the addition of a small effective amount of an aluminum salt of a higher fatty acid to the composition.

The aluminum salt stabilizing agents are the subject matter of the commonly assigned copending application Ser. No. 725,455, filed Apr. 22, 1985, the disclosure of which is incorporated herein by reference.

The preferred higher aliphatic fatty acids will have from about 8 to about 22 carbon atoms, more preferably from about 10 to 20 carbon atoms, and especially preferably from about 12 to 18 carbon atoms. The aliphatic radical may be saturated or unsaturated and may be straight or branched. As in the case of the nonionic surfactants, mixtures of fatty acids may also be used, such as those derived from natural sources, such as tallow fatty acid, coco fatty acid, etc.

Examples of the fatty acids from which the aluminum salt stabilizers can be formed include, decanoic acid, dodecanoic acid, palmitic acid, myristic acid, stearic acid, oleic acid, eicosanoic acid, tallow fatty acid, coco fatty acid, mixtures of these acids, etc. The aluminum salts of these acids are generally commercially available, and are preferably used in the triacid form, e.g. aluminum stearate as aluminum tristearate $Al(C_{17}H_{35}COO)_3$. The monoacid salts, e.g. aluminum monostearate, $Al(OH)_2(C_{17}H_{35}COO)$ and diacid salts, e.g. aluminum distearate, $Al(OH)(C_{17}H_{35}COO)_2$, and mixtures of two or three of the mono-, di- and triacid aluminum salts can also be used. It is most preferred, however, that the triacid aluminum salt comprises at least 30%, preferably at least 50%, especially preferably at least 80% of the total amount of aluminum fatty acid salt.

The aluminum salts, as mentioned above, are commercially available and can be easily produced by, for example, saponifying a fatty acid, e.g. animal fat, stearic acid, etc., followed by treatment of the resulting soap with alum, alumina, etc.

Although applicants do not wish to be bound by any particular theory of the manner by which the aluminum salt functions to prevent settling of the suspended particles, it is presumed that the aluminum salt increases the wettability of the solid surfaces by the nonionic surfactant. This increase in wettability, therefore, allows the suspended particles to more easily remain in suspension.

Only very small amounts of the aluminum salt stabilizing agent is required to obtain the significant improvements in physical stability.

In addition to its action as a physical stabilizing agent, the aluminum salt has the additional advantages over other physical stabilizing agents that it is non-ionic in character and is compatible with the nonionic surfactant component and does not interfere with the overall detergency of the composition; it exhibits some anti-foaming effect; it can function to boost the activity of fabric softeners, and it confers a longer relaxation time to the suspensions.

BLEACHING AGENTS

The bleaching agents are classified broadly, for convenience, as chlorine bleaches and oxygen bleaches. Chlorine bleaches are typified by sodium hypochlorite (NaOCl), potassium dichloroisocyanurate (59% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U.S. Pat. No. 4,264,466 or in column 1 of U.S. Pat. No. 4,430,244, the relevant disclosures of which are incorporated herein by reference. Polyacylated compounds are preferred activators; among these, compounds such as tetraacetyl ethylene diamine ("TAED") and pentaacetyl glucose are particularly preferred.

Other useful activators include, for example, acetylsalicylic acid derivatives, ethylidene benzoate acetate and its salts, ethylidene carboxylate acetate and its salts, alkyl and alkenyl succinic anhydride, tetraacetylglycouril ("TAGU"), and the derivatives of these. Other useful classes of activators are disclosed, for example, in U.S. Pat. No. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions.

Suitable sequesting agents for this purpose include sodium salts of nitrilotriacetic acid (NTA), ethylene diamine tetraacetic acid (EDTA), diethylene triamine pentaacetic acid (DETPA), diethylene triamine pentamethylene phosphonic acid (DTPMP) sold under the tradename Dequest 2066; and ethylene diamine tetramethylene phosphonic acid (EDITEMPA). The sequestering agents can be used alone or in admixture.

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred nonaqueous compositions of this invention, suitable amounts of the hydroxylamine salt inhibitors can be as low as about 0.01 to 0.4%. Generally, however, suitable amounts of enzyme inhibitors are up to about 15%, for example, 0.1 to 10%, by weight of the composition.

In addition to the detergent builders, various other detergent additives or adjuvants may be present in the detergent product to give it additional desired properties, either of functional or aesthetic nature. Thus, there may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxymethyl cellulose having a 2:1 ratio of CM/MC which is sold under the tradename Relatin DM 4050.

Optical brighteners for cotton, polyamide and polyester fabrics can be used. Suitable optical brighteners include stilbene, triazole and benzidine sulfone compositions, especially sulfonated substituted triazinyl stilbene, sulfonated naphthotriazole stilbene, benzidene sulfone, etc., most preferred are stilbene and triazole combinations.

Enzymes, preferably proteolytic enzymes, such as subtillsin, bromelin, papain, trypsin and pepsin, as well as amylase type anzymes, lipase type enzymes, and mixtures thereof can be used. Preferred enzymes include protease slurry, esperase slurry and amylase. A preferred enzyme is Esperse SL8 which is a protease. Anti-foam agents, e.g. silicon compounds, such as Silicane L 7604 can also be added in small effective amounts.

Bactericides, e.g. tetrachlorosalicylanilide and hexachlorophene, fungicides, dyes, pigments (water dispersible), preservatives, ultraviolet absorbers, anti-yellowing agents, such as sodium carboxymethyl cellulose, pH modifiers and pH buffers, color safe bleaches, perfume, and dyes and bluing agents such as ultramarine blue can be used.

The composition may also contain an inorganic insoluble thickening agent or dispersant of very high surface area such as finely divided silica of extremely fine particle size (e.g. of 5–100 millimicrons diameters such as sold under the name Aerosil) or the other highly voluminous inorganic carrier materials disclosed in U.S. Pat. No. 3,630,929, in proportions of 0.1–10%, e.g. 1 to 5%. It is preferable, however, that compositions which form peroxyacids in the wash bath (e.g. compositions containing peroxygen compound and activator therefor) be substantially free of such compounds and of other silicates; it has been found, for instance, the silica and silicates promote the undesired decomposition of the peroxyacid.

In an embodiment of the invention the stability of the builder salts in the composition during storage and the dispersibility of the composition in water is improved by grinding and reducing the particle size of the solid builders to less than 100 microns, preferably less than 40 microns and more preferably to less than 10 microns. The solid builders, e.g. alkali metal polyphosphates, are generally supplied in particle sizes of about 100, 200 or 400 microns. The nonionic liquid surfactant phase can be mixed with the solid builders prior to or after carrying out the grinding operation.

In a preferred embodiment of the invention, the mixture of liquid nonionic surfactant and solid ingredients is subjected to an attrition type of mill in which the particle sizes of the solid ingredients are reduced to less than about 10 microns, e.g. to an average particle size of 2 to 10 microns or even lower (e.g. 1 micron). Preferably less than about 10%, especially less than about 5% of all the suspended particles have particle sizes greater than 10 microns. Compositions whose dispersed particles are of such small size have improved stability against separation or settling on storage. Addition of the acid terminated nonionic surfactant compound aids in the dispersibility of the dispersions without a corresponding decrease in the dispersions stability against settling.

In the grinding operation, it is preferred that the proportion of solid ingredients be high enough (e.g. at least about 40% such as about 50%) that the solid particles are in contact with each other and are not substantially shielded from one another by the nonionic surfactant liquid. After the grinding step any remaining liquid nonionic surfactant can be added to the ground formulation. Mills which employ grinding balls (ball mills) or similar mobile grinding elements have given very good results. Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall mill) may be employed; when using such a mill, it is desirable to pass the blend of nonionic surfactant and solids first through a mill which does not effect such fine grinding (e.g. a colloid mill) to reduce the particle size to less than 100 microns (e.g. to about 40 microns) prior to the step of grinding to an average particle diameter below about 10 microns in the continuous ball mill.

In the preferred heavy duty liquid laundry detergent compositions of the invention, typical proportions (percent based on the total weight of composition, unless otherwise specified) of the ingredients are as follows:

Liquid nonionic surfactant detergent in the range of about 20 to 60, such as 25 to 50 and 30 to 40 percent.

Acid terminated nonionic surfactant may be omitted, it is preferred however that it be added to the composition in an amount in the range of about 0 to 30, such as 5 to 25 and 5 to 15 percent.

Heptonate acid builder salt in the range of about 5 to 50, such as 10 to 40 and 25 to 35 percent.

Polyphosphate detergent builder salt in the range of about 0 to 50 percent, such as 0 to 30 and 5 to 15 percent.

Copolymer of polyacrylate and polymaleic anhydride alkali metal salt anti encrustation agent in the range of about 0 to 10, such as 2 to 8 and 2 to 6 percent.

Alkylene glycol monoalkylether anti-gel agent in an amount in the range of about 0 to 20, such as 5 to 15 and 8 to 12 percent.

Phosphoric acid alkanol ester stabilizing agent in the range of 0 to 2.0 or 0.1 to 1.0, such as 0.10 to 0.5 percent.

Aluminum salt of fatty acid stabilizing agent in the range of about 0 to 3.0, such as 0.1 to 2.0 and 0.5 to 1.5 percent.

It is preferred that at least one of phosphoric acid ester or aluminum salt stabilizing agents be included in the composition.

Bleaching agent in the range of about 0 to 35, such as 5 to 30 and 8 to 15 percent.

Bleach activator in the range of about 0 to 25, such as 3 to 20 and 4 to 8 percent.

Sequestering agent for bleach in the range of about 0 to 3.0, preferably 0.5 to 2.0 and 0.5 to 1.5 percent.

Anti-redeposition agent in the range of about 0 to 3.0, such as 0.5 to 2.0 and 0.5 to 1.5 percent.

Optical brightener in the range of about 0 to 2.0, such as 0.1 to 1.5 and 0.3 to 1.0 percent.

Enzymes in the range of about 0 to 3.0, such as 0.5 to 2.0 and 0.5 to 1.5 percent.

Perfume in the range of about 0 to 2.0, such as 0.10 to 1.0 and 0.5 to 1.0 percent.

Dye in the range of about 0 to 1.0, such as 0.0025 to 0.050 and 0.25 to 0.0100 percent.

Various of the previously mentioned additives can optionally be added to achieve the desired function of the added materials.

Mixtures of the acid terminated nonionic surfactant and the alkylene glycol alkyl ether anti-gel agents can be used and in some cases advantages can be obtained by the use of such mixture alone, or with the addition to the mixture of a stabilizing and anti settling agent, e.g. phosphoric acid alkanol ester.

In the selection of the additives, they will be chosen to be compatible with the main constitutents of the detergent composition. In this application, as mentioned above, all proportions and percentages are by weight of the entire formulation or composition unless otherwise indicated.

The concentrated nonaqueous nonionic liquid detergent composition of the present invention dispenses readily in the water in the washing machine. The presently used home washing machines normally use 175 gms of powder detergent to wash a full load of laundry. In accordance with the present invention only about 77 ml or about 100 gms of the concentrated liquid nonionic detergent composition is needed.

In a preferred embodiment of the invention the detergent composition of a typical formulation is formulated using the below named ingredients:

| | Weight % |
|---|---|
| Nonionic surfactant detergent. | 30–40 |
| Acid terminated surfactant. | 5–15 |
| Alkali metal heptonic acid builder salt. | 25–35 |
| Anti-encrustation agent (Sokalan CP-5). | 0–10 |
| Polyphosphate builder salt. | 0–30 |
| Alkylene glycol monoalkyl ether. | 8–12 |
| Alkanol phosphoric acid ester. | 0.1–0.5 |
| Anti-redeposition agent (Relatine DM 4050) | 0–3.0 |
| Alkali metal perborate bleaching agent. | 8–15 |
| Bleach activator (TAED). | 4–8 |
| Sequestering agent (Dequest 2066). | 0–3.0 |
| Optical brightener (ATS-X). | 0.05–1.0 |
| Enzymes (Protease-Esperase SL8). | 0.5–1.5 |
| Perfume. | 0.5–1.0 |

The present invention is further illustrated by the following example.

EXAMPLE 1

A concentrated nonaqueous liquid nonionic surfactant detergent composition is formulated from the following ingredients in the amounts specified.

| | Weight % |
|---|---|
| A mixture of $C_{13}$—$C_{15}$ fatty alcohol condensed with 7 moles of propylene oxide and 4 moles ethylene oxide and $C_{13}$—$C_{15}$ fatty alcohol condensed with 5 moles propylene oxide and 10 moles ethylene oxide. | 13.5 |
| Surfactant T 7. | 10.0 |
| Surfactant T 9. | 10.0 |
| Acid terminated Dobanol 91-5 reaction product with succinic anhydride. | 5.0 |
| Sodium salt of heptonic acid. | 28.7 |
| Diethylene glycol monobutyl ether. | 10.0 |
| Alkanol phosphoric acid ester (Empephos 5632). | 0.3 |
| Anti-encrustation agent (Sokalan CP-5). | 4.0 |
| Sodium perborate monohydrate bleaching agent. | 9.0 |
| Sodium carbonate. | 0.9 |
| Tetraacetylethylene diamine (TAED) bleach activator. | 4.5 |
| Sequestering agent (Dequest 2066). | 1.0 |
| Optical brightener (Tinopal ATS-X). | 0.5 |
| Anti-redeposition agent (Relatin DM 4050). | 1.0 |
| Esperase slurry (Esperase SL8). | 1.0 |
| Perfume. | 0.5925 |
| Dye | .0075 |
| | 100.00 |

The formulation is ground for about 1 hour to reduce the particle size of the suspended builder salts to less than 40 microns. The formulated detergent composition is found to be stable and non-gelling in storage and to have a high detergent capacity.

The formulation exhibits yield stress of 5.0 P.a. and an apparent viscosity of 1.1 P.a. S-1.

The formulations can be prepared without grinding the builder salts and suspended solid particles to a small particle size, but best results are obtained by grinding the formulation to reduce the particle size of the suspended solid particles.

The builder salts can be used as provided, or the builder salts and suspended solid particles can be ground or partially ground prior to mixing them with the nonionic surfactant. The grinding can be carried out in part prior to mixing and grinding completed after mixing or the entire grinding operation can be carried out after mixing with the liquid surfactant.

EXAMPLE 2

In order to demonstrate the effect on encrustation of the substitutuion of sodium polyphosphate by an equivalent detergent builder amount of sodium heptonate, the detergent composition formulation of Example 1 containing 28.7% by weight of sodium heptonate was compared in laundry washing machine use with the same composition in which the sodium heptonate was replaced with 28.7% by weight of sodium polyphosphate.

The wash cycles were carried out at concentrations of the sodium heptonate and sodium polyphosphate detergent compositions at laundry wash water concentrations of each of the detergent compositions of 1 to 9 gm/liter of the respective detergent compositions.

After 6 wash cycles of each detergent composition was used in a washing machine the amount of encrustation that resulted, i.e. the percent ash deposited was measured. The percent ash deposited measurement is determined by calcination of wash swatches.

The results observed are reported in the graph illustrated in the FIG. 1 drawing and show that at detergent composition concentrations of 1 to 5 g/l of wash water the sodium heptonate is substantially better than sodium polyphosphate in preventing encrustation or ash deposit. At detergent composition concentrations of about 5 to 9 g/l of wash water the behavior of sodium heptonate and sodium polyphosphate detergent builder salts are about the same in their anti-encrustation properties.

EXAMPLE 3

In order to demonstrate the effect on encrustation buildup of the substitution of sodium polyphosphate by an equivalent detergent builder amount of sodium heptonate, the detergent composition of Example 1 containing 28.7 percent by weight of sodium heptonate was compared in repeated laundry wash machine wash cycles with the same composition in which the sodium heptonate was replaced with 28.7 percent by weight of sodium polyphosphate.

The repeated wash cycles were carried out at 5 g/l wash water concentrations of each of the detergent compositions for twelve washing cycles. The encrustation buildup, i.e. percent ash buildup was measured in each washing machine after 3, 6, 9 and 12 washings.

Figure 2:
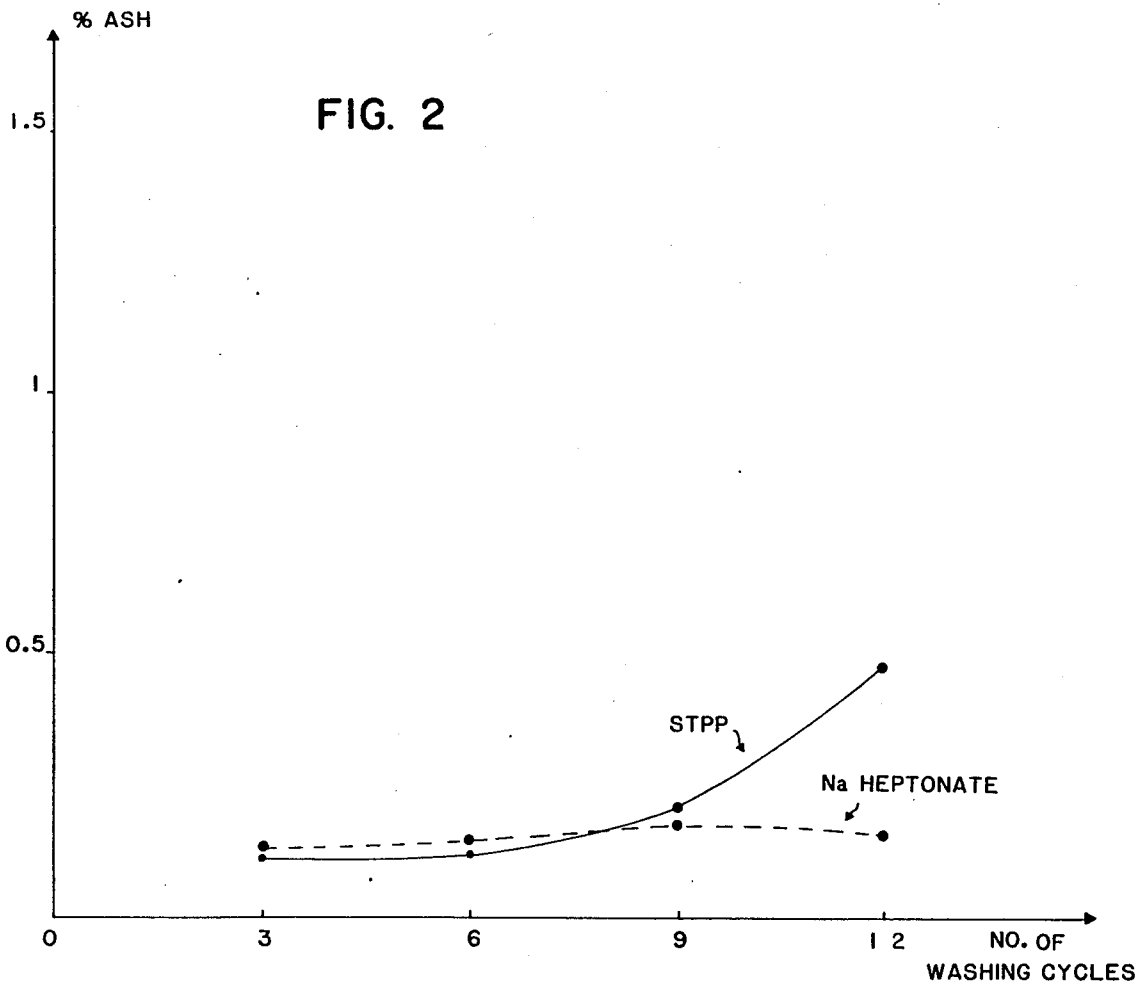

The results of encrustation buildup obtained is reported in the graph illustrated in the FIG. 2 drawing. As far as the encrustation buildup is concerned, no buildup was observed with the sodium heptonate, whereas a small buildup was observed with the sodium polyphosphate detergent builder salt.

The alkali metal heptonate detergent builder salts can also be used to replace all or part of the polyphosphate builder salts in powder detergent compositions, and in aqueous and cream detergent compositions with good effect.

It is understood that the foregoing detailed description is given merely by way of illustration and that variations may be made therein without departing from the spirit of the invention.

What is claimed is:

1. A nonaqueous liquid heavy duty laundry detergent composition which comprises 20 to 60 percent of at least one liquid nonionic surfactant detergent and 5 to 50 percent of an alkali metal heptonic acid builder salt.

2. The detergent composition of claim 1 comprising at least one of the members of the group consisting of a polycarboxylic acid terminated nonionic surfactant anti-gel agent, a $C_2$ to $C_3$ alkylene glycol mono $C_1$ to $C_5$ alkyl ether and a $C_8$ to $C_{20}$ alkanol phosphoric acid ester stabilizing agent.

3. The detergent composition of claim 1 comprising one or more detergent adjuvants selected from the group consisting of bleaching agent, bleach activator, optical brightener, enzymes and perfume.

4. The detergent composition of claim 1 comprising 10 to 40 percent of an alkali metal heptonic acid detergent builder salt.

5. The detergent composition of claim 1 comprising 5 to 25 percent of a polycarboxylic acid terminated surfactant.

6. The detergent composition of claim 1 comprising 0.10 to 2.0 percent of a $C_8$ to $C_{20}$ alkanol phosphoric acid ester.

7. The detergent composition of claim 1 comprising about 5 to 15 percent of a $C_2$ to $C_3$ alkylene glycol $C_1$ to $C_5$ alkyl mono-ether.

8. The detergent composition of claim 1 wherein the nonionic surfactant has dispersed therein detergent builder particles having a particle size distribution such that no more than about 10% by weight of said particles have a particle size of more than about 10 microns.

9. The laundry detergent composition of claim 1 which is polyphosphate free or low polyphosphate and which additionally comprises at least one liquid nonionic surfactant in an amount of about 25 to 50%, a polycarboxylic acid-terminated nonionic surfactant in an amount of about 5 to 25%, an alkali metal heptonic acid builder salt in an amount of about 10 to 40%, a $C_2$ to $C_3$ alkylene glycol mono $C_1$ to $C_5$ alkyl ether in an amount of about 5 to 15%, a polyphosphate detergent builder in an amount of about 0 to 30%, and a $C_{16}$ to $C_{18}$ alkanol phosphoric acid ester in an amount of about 0.1 to 1.0%.

10. The laundry detergent compositon of claim 9 additionally comprising an alkali metal perborate monohydrate bleaching agent in an amount of about 5 to 30%, tetraacetylethylene diamine bleach activation in an amount of about 3 to 20%, and one or more detergent adjuvants selected from the group consisting of anti-encrustation agent, anti-redeposition agent, optical brighteners, enzymes and perfume.

11. The laundry detergent composition of claim 9 where the detergent builder comprises 25 to 35 percent of an alkali metal salt of heptonic acid.

12. The detergent composition of claim 9 wherein the sodium salt of heptonic acid has the formula

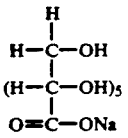

13. The detergent composition of claim 9 which is free of phosphate detergent builder.

14. The laundry detergent composition of claim 9 wich is pourable at high and low temperatures, is stable in storage and does not gel when mixed with cold water.

15. The detergent composition of claim 9 which comprises a polyphosphate builder salt in an amount of about 5 to 15 percent.

16. A phosphate detergent builder free nonaqueous liquid heavy duty laundry detergent composition which comprises

| | |
|---|---|
| Nonionic surfactant in an amount of about | 30–40% |

-continued

| | |
|---|---|
| Polycarboxylic Acid Terminated surfactant in an amount of about | 5–15% |
| Sodium salt of heptonic acid in an amount of about | 25–35% |
| [Alkylene] Diethylene glycol monobutyl ether in an amount of about | 8–12% |
| $C_{16}$ to $C_{18}$ alkanol ester of phosphoric acid in an amount of about | 0.1–0.5% |
| Sodium perborate monohydrate bleaching agent in an amount of about | 8–15% |
| Tetraacetylethylene diamine (TAED) bleach activator in an amount of about | 4–8% |

17. The detergent composition of claim 16 wherein the composition comprises an anti-redeposition agent and anti-encrustation agent.

18. A method for cleaning soiled fabrics which comprises contacting the soiled fabrics with an effective cleaning amount of the laundry detergent composition of claim 9.

19. The method of claim 18 for cleaning soiled fabrics which comprises contacting the soild fabrics with the laundry detergent composition of claim 9.

20. The method of claim 18 for cleaning soiled fabrics which comprises contacting the soiled fabrics with the laundry detergent composition of claim 16.

* * * * *